US006129480A

United States Patent [19]

Cunningham

[11] Patent Number: 6,129,480

[45] Date of Patent: Oct. 10, 2000

[54] BI-DIRECTIONAL CONCRETE FINISHING MACHINE

[75] Inventor: John Paul Cunningham, Hurricane, W. Va.

[73] Assignee: Terramite Corporation, Charleston, W. Va.

[21] Appl. No.: 09/276,763

[22] Filed: Mar. 26, 1999

[51] Int. Cl.[7] ..... E01C 19/26

[52] U.S. Cl. ..... 404/75; 404/103

[58] Field of Search ..... 404/102, 103, 404/119, 120, 122, 123, 75

[56] References Cited

U.S. PATENT DOCUMENTS

| | | | |
|---|---|---|---|
| D. 425,082 | 5/2000 | Cunningham | D15/122 |
| 1,760,596 | 5/1930 | Heltzel . | |
| 3,221,618 | 12/1965 | Hudis . | |
| 3,605,577 | 9/1971 | Bik . | |
| 3,870,427 | 3/1975 | Allen . | |
| 4,142,815 | 3/1979 | Mitchell . | |
| 4,422,375 | 12/1983 | Morganti . | |
| 4,614,486 | 9/1986 | Bragagnini | 425/62 |
| 4,650,366 | 3/1987 | Morrison . | |
| 4,688,964 | 8/1987 | Cox | 404/75 |
| 4,747,726 | 5/1988 | Garner et al. | 404/123 |
| 4,964,754 | 10/1990 | Garner et al. | 404/123 |
| 5,046,889 | 9/1991 | Sterner, Jr. | 404/103 |
| 5,190,400 | 3/1993 | Sterner | 404/103 |
| 5,456,549 | 10/1995 | Paladeni | 404/103 |
| 5,468,094 | 11/1995 | Vanderpan et al. | 404/75 |
| 5,562,361 | 10/1996 | Allen . | |
| 5,664,908 | 9/1997 | Paladeni | 404/103 |

FOREIGN PATENT DOCUMENTS 469687 2/1992 European Pat. Off. .

*Primary Examiner*—James A. Lisehora
*Attorney, Agent, or Firm*—Sughrue, Mion, Zinn, Macpeak & Seas, PLLC

[57] ABSTRACT

A bi-directional concrete finishing machine finishes a concrete surface in both a forward and a reverse direction, and includes a leading finishing roller and a trailing finishing roller which rotate in a first direction, and two tramming rollers disposed between the leading and trailing finishing rollers, which rotate in a second direction, such that the tramming rollers can be driven in the second direction to move the concrete finishing machine forward and, with the trailing finishing roller disengaged, the leading finishing roller can rotate in the first direction and level the concrete to grade. When the machine is reversed by driving the tramming rollers in the first direction, the leading finishing roller is disengaged, and the trailing finishing roller is driven in the second direction and levels the concrete to grade. Another embodiment of the machine includes a concrete auger for roughing the concrete and spreading it out evenly, which is added as a fifth roller to the machine. Still another embodiment includes a steering mechanism which is extended from under the machine and allows the machine to turn in any direction. A lifting cradle lifts the concrete finishing machine into place over the unfinished concrete.

30 Claims, 16 Drawing Sheets

BI-DIRECTIONAL CONCRETE FINISHING MACHINE

The present invention relates to a concrete finishing machine, which can finish the surface of concrete roads, pavements, side-walks, floors, platforms, etc., in a smooth texture and in a bi-directional manner.

BACKGROUND OF THE INVENTION

Concrete finishing goes back many decades and various roller devices have been used to effect a leveling or finishing of the concrete material in a given area. Many of these machines are designed to operate on rails (screeds) or form walls and are utilized to effect a leveling of the unset concrete within the form. Typically, grading and finishing work has been accomplished by hand operated screeds or trowels. However, manual operations have made grading and finishing of concrete surfaces time consuming and expensive.

In attempting to ease the time and cost burdens in grading and finishing concrete surfaces, a concrete finishing machine having a strike-off roller which grades and finishes in one direction, with a tramming roller which counter-rotates in a second direction, has been used to rapidly grade the concrete slab and provide a level surface, and which substantially reduces the grading time. With the high rotation of the strike-off roller, concrete does not accumulate on the roller and thus, disturb the leveling of the concrete. Thus, conventional triple roller finishing machines 1 (see FIGS. 1 and 2), which include one strike-off roller 2 and two counter-rotating tramming rollers 3, 4, are now used conventionally to rapidly grade and level a concrete surface.

DESCRIPTION OF THE RELATED ART

The prior art concrete finishing machines all suffer from the same deficiency, in that the rollers all finish the concrete surface in one direction, although some machines are bi-directional in movement.

For example, the conventional triple roller concrete finishing machine (see FIGS. 1 and 2) has a front oscillating strike-off roller 2 which rotates counter clockwise at a high rotation (i.e., RPM). The counter clockwise operation whips the concrete into a roll and smoothes the concrete to the form. The front strike-off roller 2 is offset by a small amount, roughly ⅛ inch, to allow the strike-off roller 2 to knead the concrete to the top of the form. The two tramming rollers 3, 4 or tubes propel the machine 1 forward or reverse. These rollers 3, 4 are parallel and travel at a much lower RPM. The last tramming roller 4 of the two tramming rollers 3, 4, rolls clockwise over the concrete and whips up the grout or mud. This gives the finish an appearance of "stucco", which is unacceptable.

Examples of this type of conventional triple roller machine include Hudis (U.S. Pat. No. 3,221,618), Allen (U.S. Pat. No. 3,870,427, hereafter Allen '427) and Allen (U.S. Pat. No. 5,562,361, hereafter Allen '361).

In particular, Hudis discloses a spreader unit 21 which includes a spreader frame 21 followed by a strike-off member 29, and then a finishing unit 22 including two transverse metering screeds 41, 42 followed by a float pan 44, which level and shape the concrete surface. The finishing assembly finishes the concrete in only one direction.

Allen '427 discloses a finisher assembly 12 which is a combination of mechanical and hydraulic systems and which includes a first finisher 24, a second finisher 26, and an auger member 28, each rotatingly supported on a portion of the finisher assembly 12. The bi-directionality of the device is applied only to the assembly 12, not to the paving (finishing), and the finisher assembly 12 finishes the concrete in only one direction.

Finally, Allen '361 discloses a triple roller tube concrete finisher 20, which in a preferred embodiment, includes a box-like frame 22 supported by a plurality of tube rollers 110, 120, 130, rollers 110 and 120 of which are drive rollers which are journaled to a housing 60, while the roller 130 is a strike-off roller. The strike-off roller 130 is mounted for vertical movement, and spins clockwise when the finisher 20 moves forward with the strike-off roller 130 striking and leveling the concrete first. The two drive rollers 110, 120, which spin counter clockwise, propel the finisher 20 and simultaneously screed and finish the concrete. However, Allen '361 discloses that the drive and strike-off rollers 110, 120, 130 may alternatively be rotated in the opposite direction if so desired (i.e., the finisher 20 is bi-directional in movement to facilitate forward and rearward movement of the finisher 20, but the finishing of the concrete is performed only in one direction (i.e., the forward direction)). This bi-directional movement of the finisher 20 means that drive rollers 110, 120 must propel the finisher 20 forward and reverse so that the strike-off roller 130 can make repeated passes, with each pass lowering the strike-off roller 130 until it contacts the forms, for the concrete to be finished to grade. However, the finishing of the concrete is performed only in the one direction (forward direction).

Accordingly, the conventional triple roller concrete finishing machines, such as those disclosed in FIGS. 1 and 2 and in the prior art above, have the drawback that they can only finish concrete in one direction, even with bi-directional movement of the drive or tramming rollers 3, 4 (see FIG. 1, where the finishing is performed in the direction of the arrow only). Thus, the triple roller concrete finishing machine 1 has a very limited ability to give the concrete a smooth texture, and the "stucco" finish which is caused by the two tramming rollers 3, 4 rotating at a very slow speed, is unacceptable.

With conventional triple roller concrete finishing machines, in order to complete the finish, it is necessary to use hand held floats to obtain the proper smoothness of the concrete, which is time consuming, difficult over wide widths (see FIG. 2), and requires skilled workers.

Finally, with respect to the steering of the conventional triple roller concrete finishing machines, they are steered by holding or forcing the unit, or by forcing the unit against a bar or fixed object, which makes steering somewhat difficult, labor-intensive, and time-consuming.

SUMMARY OF THE INVENTION

An object of the present invention is to provide a concrete finishing machine, which can finish a concrete surface in both a forward and a reverse direction (i.e., has bi-directionality of finishing).

A further object of the invention is to simplify the mechanical construction of the concrete finishing machine.

Another object of the invention is to provide the auger separately as another roller of the concrete finishing machine, which can selectively either rough the concrete in one direction of travel (when the auger is applied), or finish the concrete surface in both a forward and reverse direction (when the auger is not applied), without having to stop the machine to change the rollers.

Still a further object of the invention is to provide a steering mechanism which can more easily steer the concrete finishing machine.

In fulfilling the above objectives, the present invention adds a fourth roller behind the final (with respect to the direction of travel) tramming roller of a conventional triple roller concrete finishing machine. This roller operates exactly like the front oscillating strike-off roller, but the addition of the fourth oscillating strike-off roller allows for greater versatility and ease of operation of the concrete finishing machine. The trailing oscillating strike-off roller (fourth roller) finishes the concrete to a smooth texture by rapid rotation in the direction of travel. Thus, the concrete finishing machine can now operate to the left or to the right from the operator's position, and the presence of the fourth (trailing) oscillating strike-off roller (with respect to the direction of travel) allows finishing of the concrete surface in two opposite directions, to a very smooth finish. The four roller concrete finishing machine is also advantageous in applications where the machine has limited clearance on one side, or has limited means to spread concrete.

The above operation and advantages minimize any secondary manual finishing, reduces the work crew, and is easier over wider widths (i.e., more than 20 feet).

Further, an auger may be added as a fifth roller which can be selectively brought into use to rough the concrete and spread it more evenly, without taking the additional time required to stop the machine and replace the leading finishing roller with an auger. Finishing is still performed in both the forward and the reverse directions when the auger is lifted.

The use of the fourth oscillating strike-off roller will also ease the steering of the concrete roller finishing machine during normal operation.

In addition, a steering mechanism which includes an adjustable draw bar can be added to the four roller concrete finishing machine, in order to ease the maneuverability of the concrete finishing machine. The adjustable draw bar is engaged and disengaged by an operator's lever, and allows the operator to steer the concrete finishing machine more easily.

These and other objects and advantages of the present invention will become apparent in the course of the following description.

BRIEF DESCRIPTION OF THE DRAWINGS

Other features and advantages of the invention will be apparent from the following description taken in connection with the accompanying drawings, wherein.

DESCRIPTION OF THE PREFERRED EMBODIMENTS

The present invention relates to a bi-directional screed four roller concrete finishing machine, whose four rollers allow finishing of a concrete surface in both the forward and the reverse directions.

Figure 1:
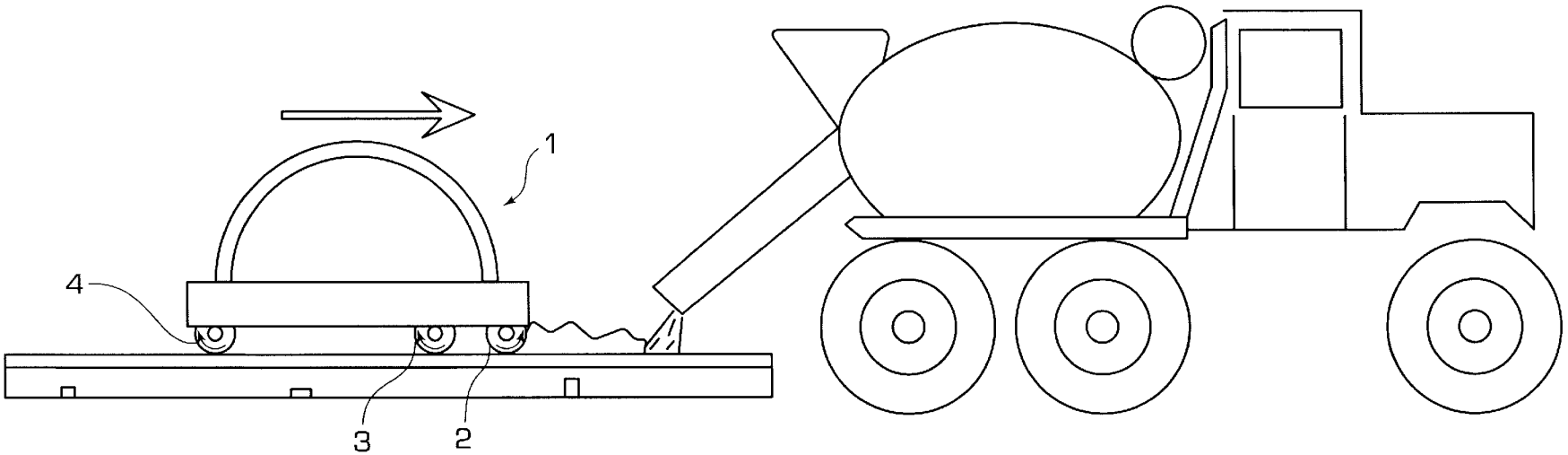
FIG. 1 PRIOR ART
FIG. 1 shows a side view of a concrete truck providing concrete to a conventional triple roller concrete finishing machine which finishes the concrete surface in the direction of the arrow.
Figure 2:
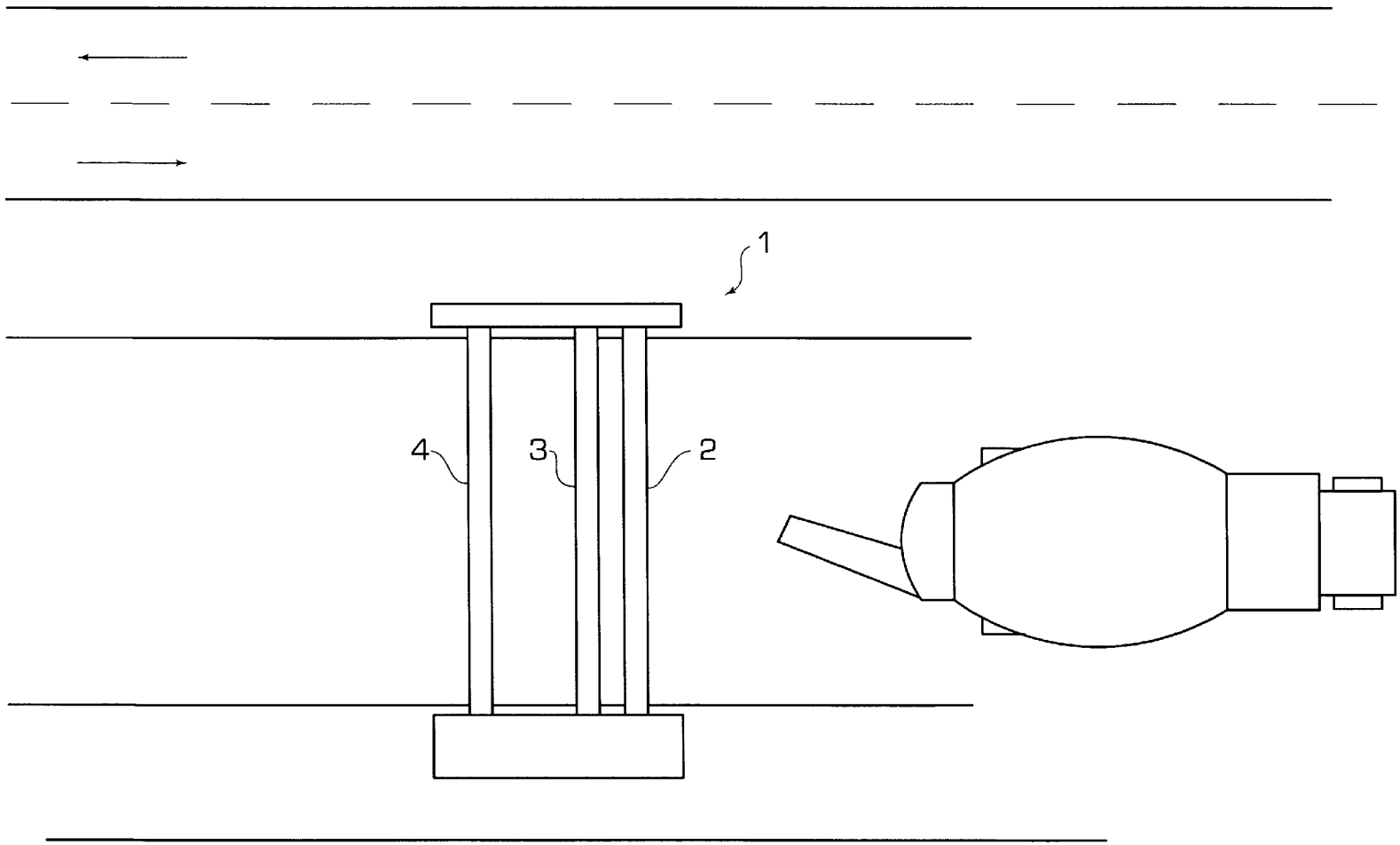
FIG. 2 PRIOR ART
FIG. 2 shows a top view of a concrete truck and a conventional triple roller concrete finishing machine adjacent a roadway.
Figure 3:
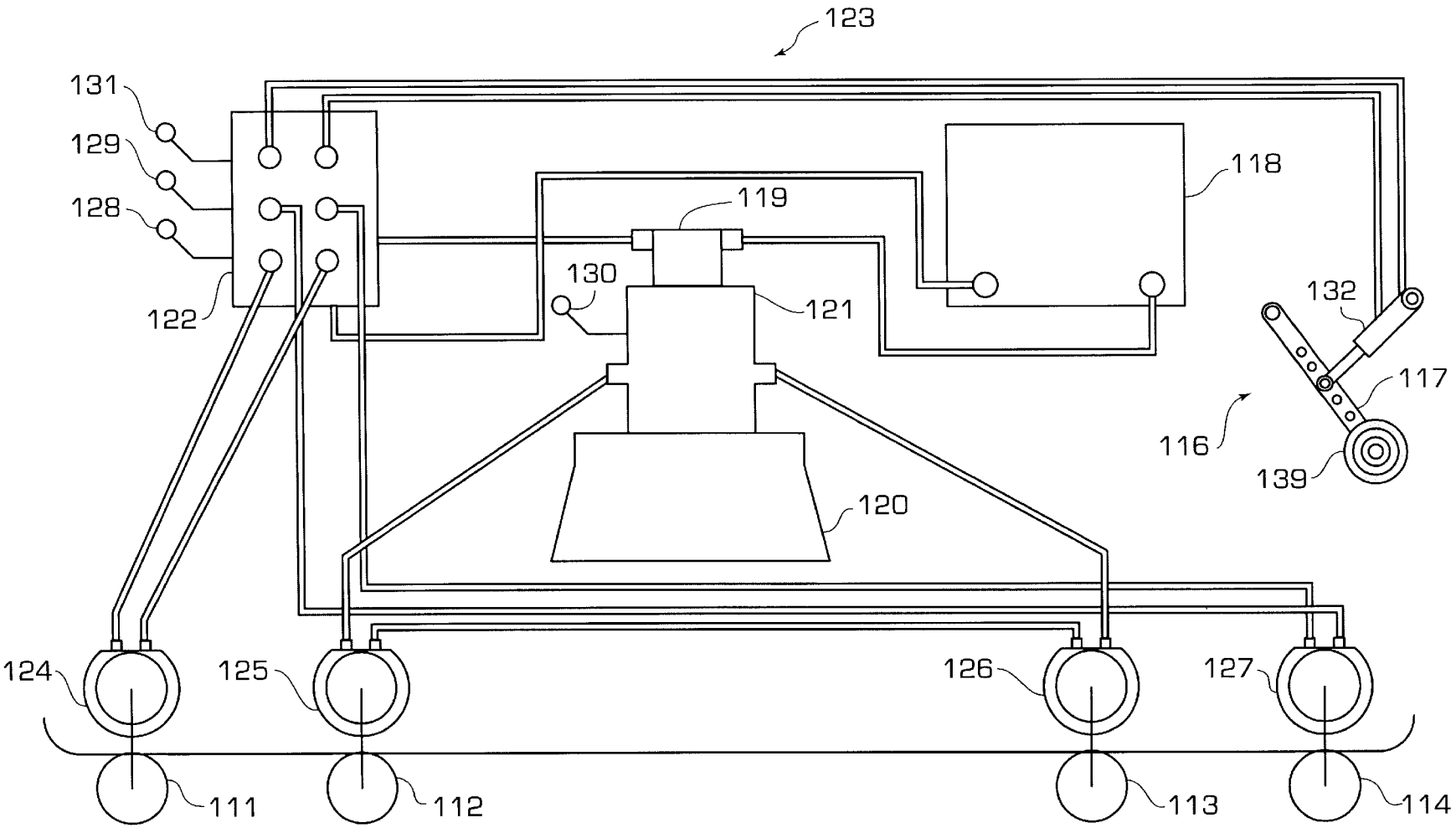
FIG. 3 shows a schematic of the hydraulic system of the four roller concrete finishing machine according to a first embodiment of the present invention.
Figure 12:
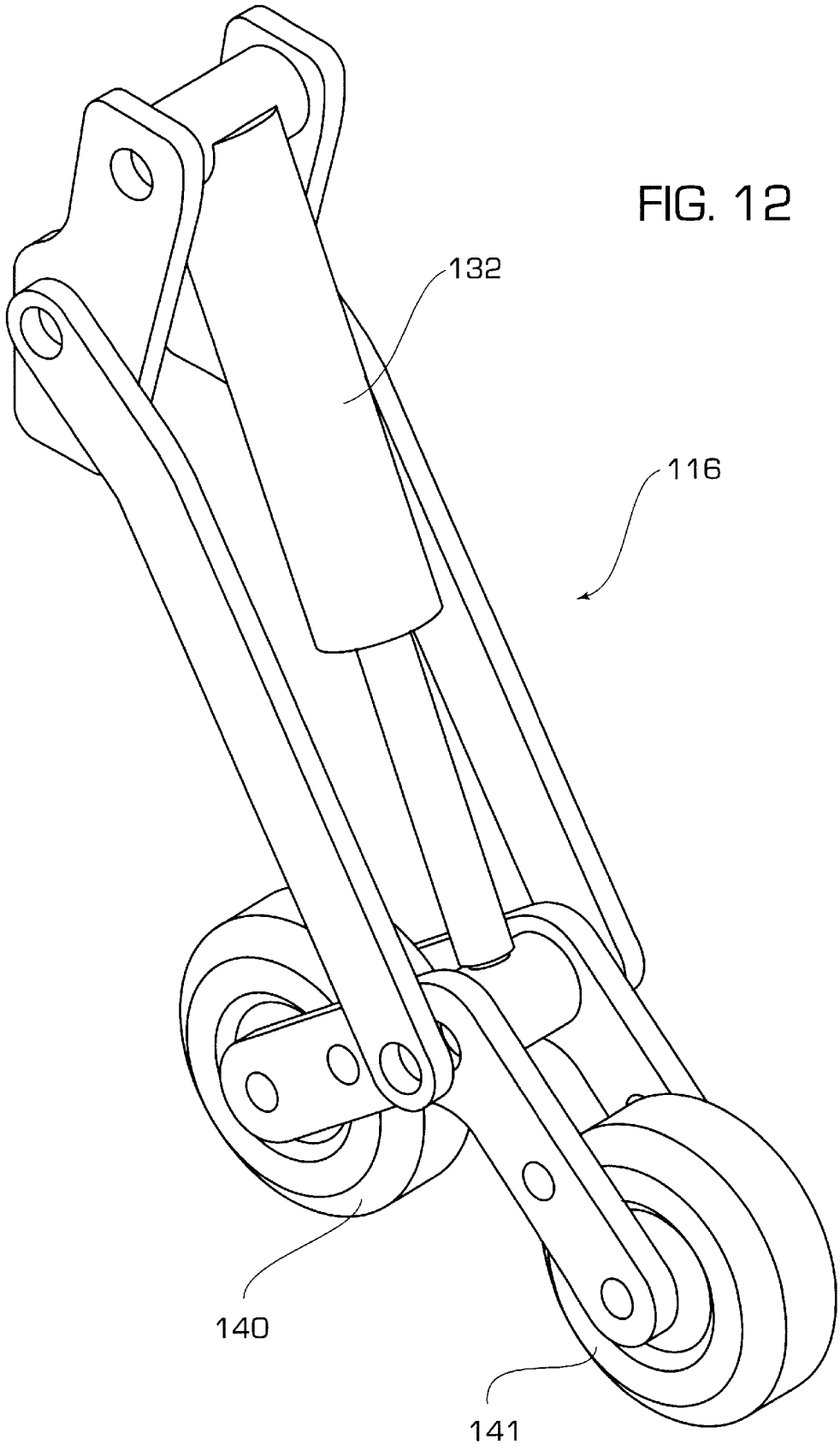
FIG. 12 shows an oblique view of an adjustable draw bar of the steering mechanism according to a variation of the third embodiment of the present invention, the adjustable draw bar being filly extended.
Figure 15:
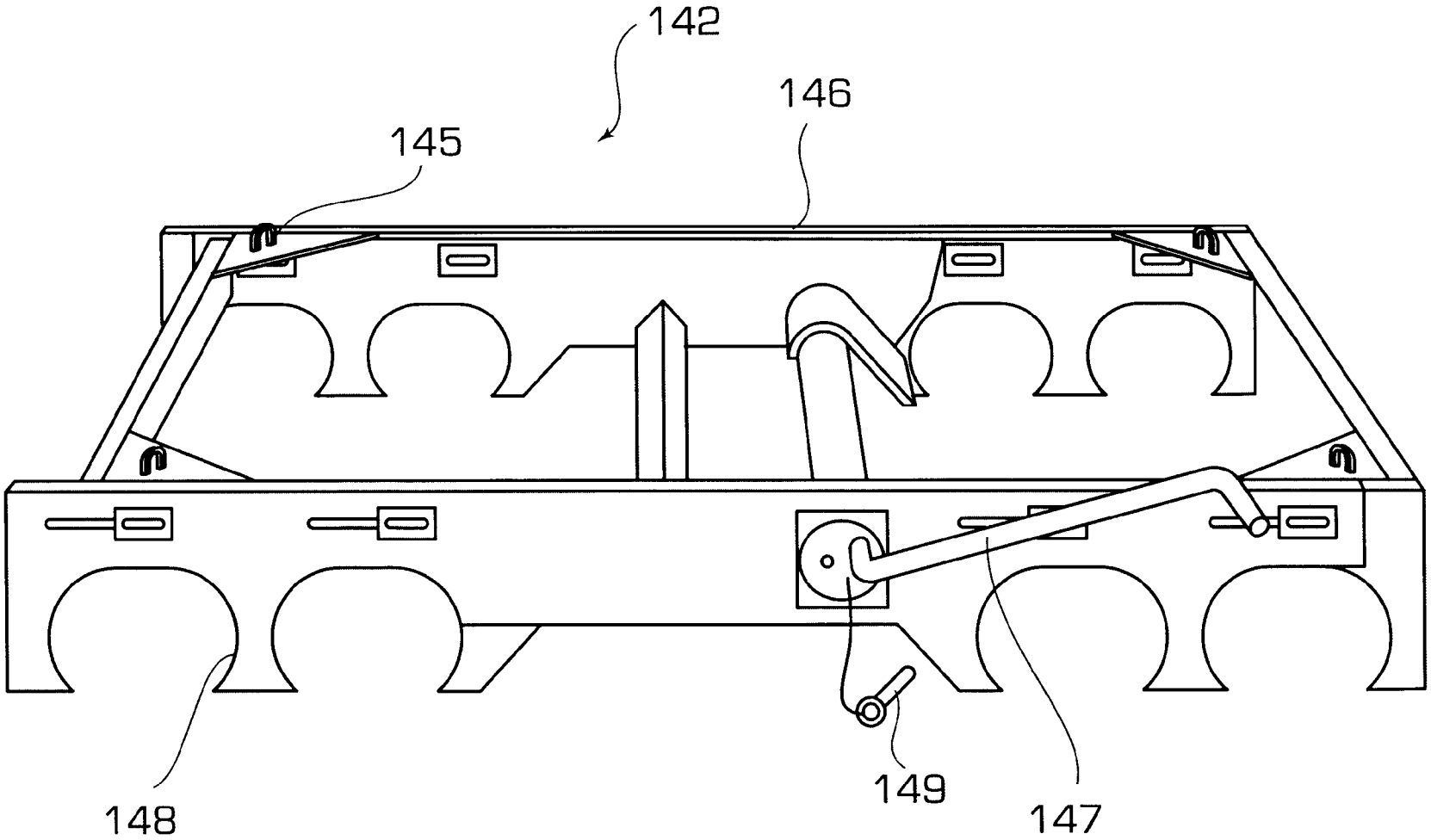
FIG. 15 shows a schematic of the lifting cradle, in the open position, according to a first embodiment of the present invention.

The four roller concrete finishing machine 100 (see FIGS. 3, 4, and 15) includes a power unit 123 (see FIG. 3), four rollers 111, 112, 113, 114, a tail assembly 115 which provides support for alignment of the rollers 111, 112, 113, 114 (provided at the rear of the machine 100), and a steering mechanism 116 which includes an adjustable draw bar 117 (see FIG. 12).

The power unit 123 (see FIG. 3) is a completely hydraulic, horizontally-disposed system, and includes an oil tank 118, pump 119, engine 120, hydraulic transmission 121, valve 122, and torque motors 124, 125, 126, 127, for driving the machine 100. The power unit uses many conventional parts, such as a hydraulic transmission 121 manufactured by Eaton, part no. 78190-RDE02, a valve 122 manufactured by Gresen, part no. SSKXT-4-4-HP, and torque motors 124–127 manufactured by TRW, part no. MB120101AAAA.

Rollers 111 and 114 are oscillating strike-off rollers, each of which can either be a leading roller or a trailing roller, depending on the direction of movement of the machine 100. Rollers 112 and 113 are tramming rollers, which rotate in the direction of travel of the machine, or which can also be driven in reverse. The movement of the rollers is described in more detail below.

Strike-off rollers 111 and 114 are connected to torque motors 124 and 127, respectively, which drive the strike-off rollers 111, 114. Levers 128, 129, which operate in a scissor motion, open and close the valve 122 to drive the torque motors 124, 127, respectively, independently of each other and of the tramming rollers 112, 113. A single lever 130 engages both the torque motors 125 and 126 to drive tramming rollers 112 and 113, respectively, in the same direction, to make the machine 100 move. The torque motors 125 and 126 for tramming rollers 112, 113 are hydraulically connected to each other as well as to the hydraulic transmission 121.

A fourth lever 131 connected to independently open and close valve 122, engages the cylinder 132 to raise and lower the adjustable draw bar 117 of the steering mechanism 116.

Figure 4:
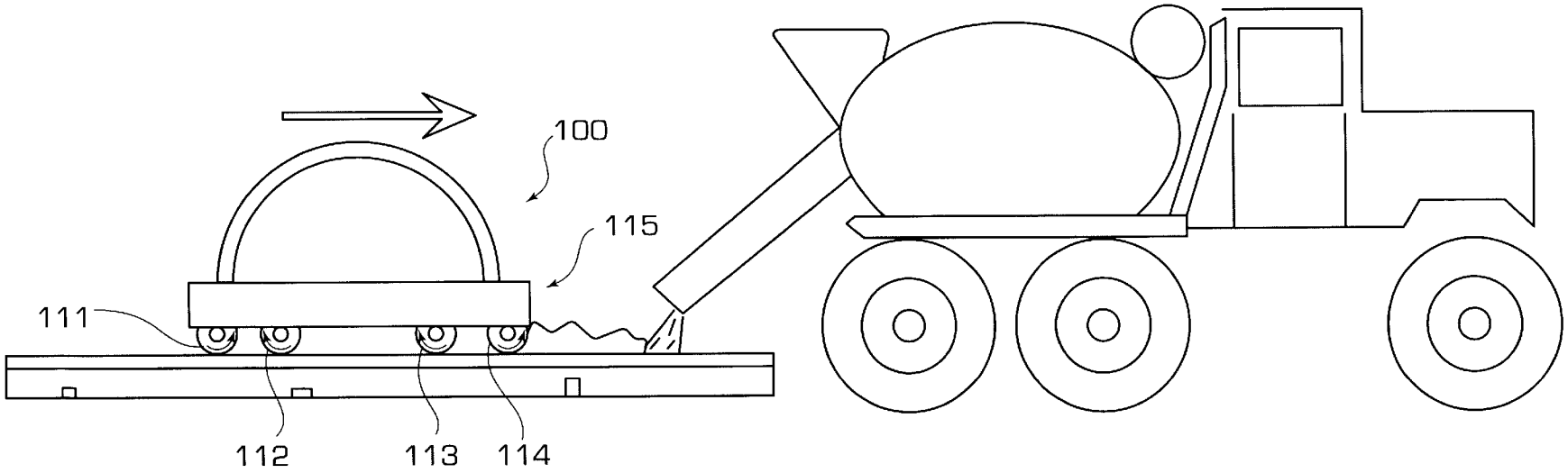
FIG. 4 shows a side view of a concrete truck discharging concrete to the four roller concrete finishing machine of the first embodiment of the present invention, the four roller concrete finishing machine being capable of finishing a concrete surface in the direction of the arrow.

The strike-off rollers 111, 114 work on the eccentric and normally rotate opposite to the forward direction of travel (i.e., counter clockwise as shown in FIG. 4, if the machine 100 is moving in the direction of the arrow). The rollers 111, 114 are located respectively, at the front and at the rear of the machine 100, and vibrate and flatten the concrete to grade. The strike-off rollers 111, 114, when engaged, rotate into rough concrete (concrete that has been placed and not leveled in any manner) at a speed of 0 up to 240 RPM.

Figure 5:
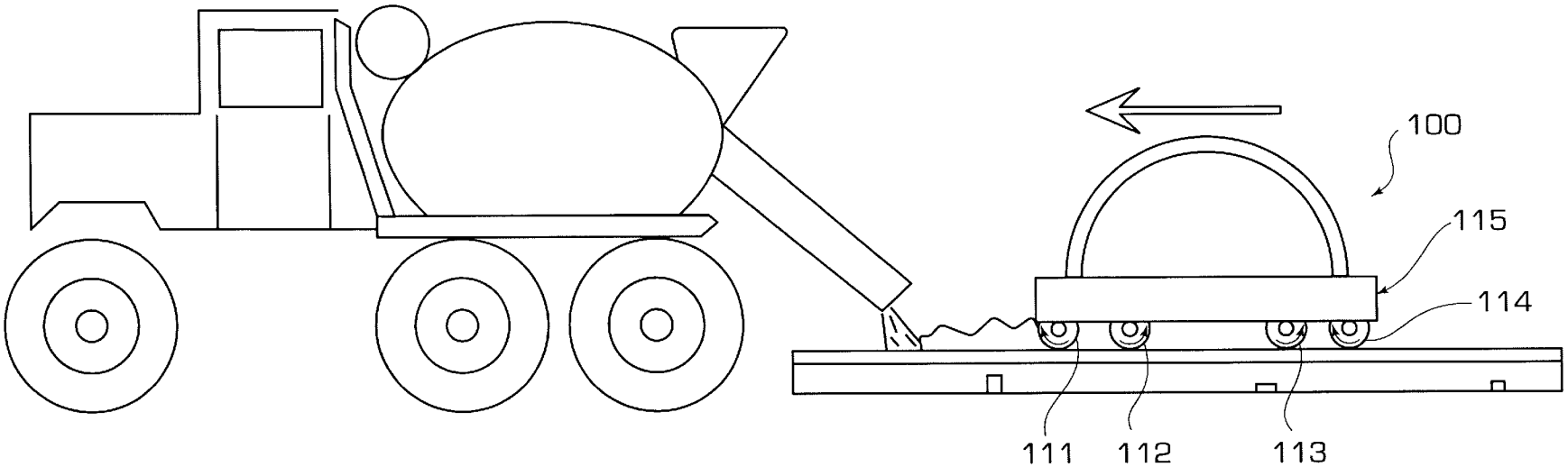
FIG. 5 shows another side view of a concrete truck providing concrete to the four roller concrete finishing machine of the first embodiment of the present invention, the four roller concrete finishing machine being capable of finishing a concrete surface in the direction of the arrow.

The tramming rollers 112, 113, which rotate in the direction of travel (i.e., clockwise as shown in FIG. 4, if the machine 100 is moving in the direction of the arrow), propel the machine forward. The tramming rollers 112, 113 rotate at a slower speed in the range between 0–60 RPM. The tramming rollers 112, 113 can also be driven in reverse (i.e., counter clockwise) by the hydraulic transmission 121 which drives the torque motors 125, 126 to drive the tramming rollers 112, 113 (see FIG. 5). In the case shown in FIG. 5, the machine 100 moves in the direction of the arrow, and the strike-off rollers 111, 114 rotate clockwise, and the tramming rollers 112, 113 rotate counter clockwise.

When the strike-off roller 114, as shown in FIG. 4, is rotated counter clockwise, it is the leading finishing roller, and is activated independently of the tramming rollers 112, 113 and the trailing finishing roller 111. The leading finishing roller 114, must be rotated counter clockwise into rough concrete. The trailing finishing roller 111 can be disengaged and remains essentially stationary as it is moved over the smoothed concrete, or engaged to rotate in the same direction as the leading finishing roller 114.

Figure 6:
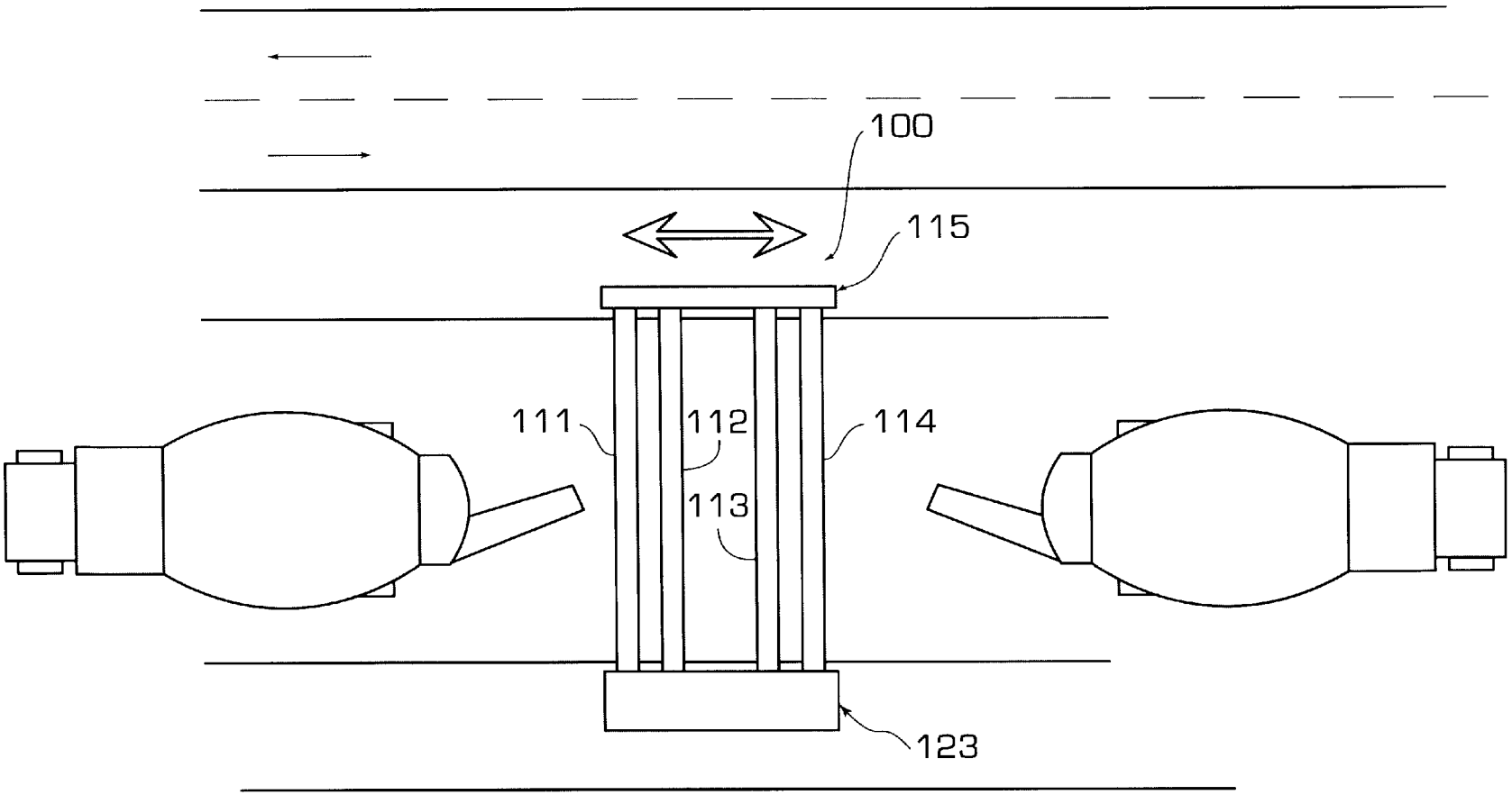
FIG. 6 shows a top view of two concrete trucks and the four roller concrete finishing machine according to the first embodiment of the present invention, the four roller concrete finishing machine being capable of finishing a concrete surface in the direction of either concrete truck.

However, the direction of travel can be reversed by disengaging the levers 129, 130 and stopping the movement of the rollers 114, and 112, 113, respectively, engaging the levers 128, 130 to drive the tramming rollers 112, 113 in the reverse (counterclockwise) direction, and to drive the trailing finishing roller 111 in the clockwise direction (see FIG. 6). In this case, the trailing finishing roller 111 now becomes the leading finishing roller, and the leading finishing roller 114 becomes the trailing finishing roller, and the roller 114 is either engaged to rotate in the same direction as the roller 111, or is disengaged to remain essentially stationary.

Thus, finishing of the concrete surface can be performed in both the forward and reverse direction of travel, which alleviates the "stucco" appearance provided by conventional triple roller concrete finishing machines, and which reduces the amount of labor necessary to hand finish and smooth the concrete surface, particularly over wider widths.

Figure 7:
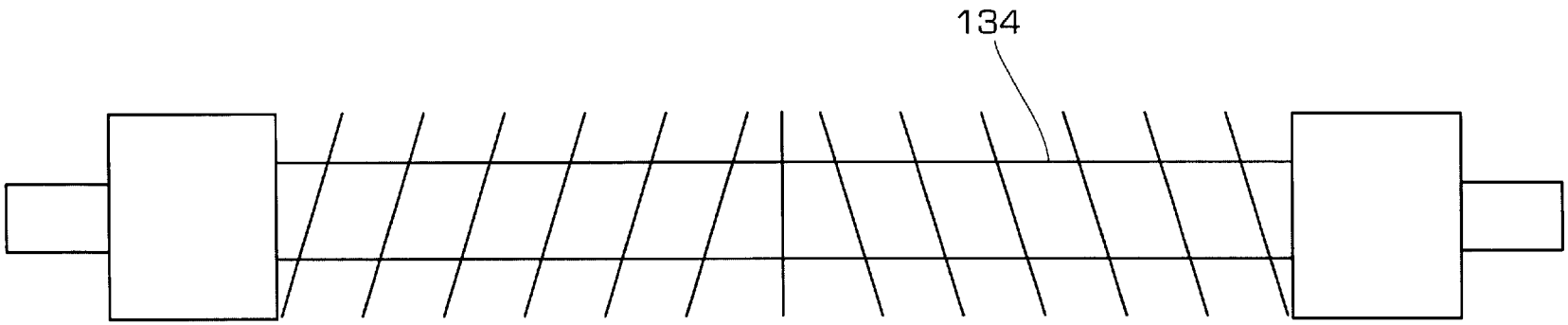
FIG. 7 shows a side view of a concrete auger.
Figure 8:
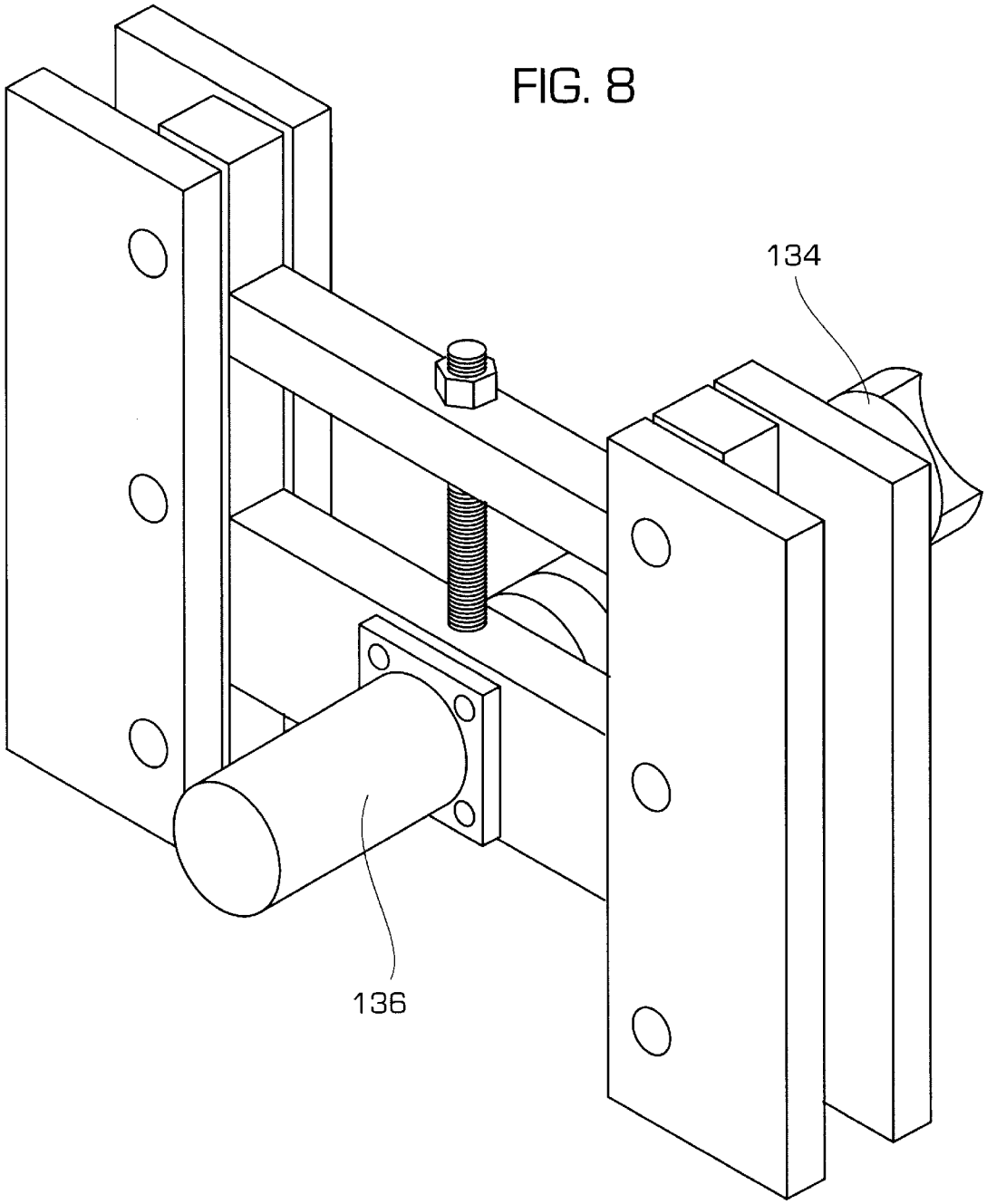
FIG. 8 shows a perspective view of an auger which is added to the four roller concrete finishing machine as a fifth roller, according to a second embodiment of the present invention.
Figure 9:
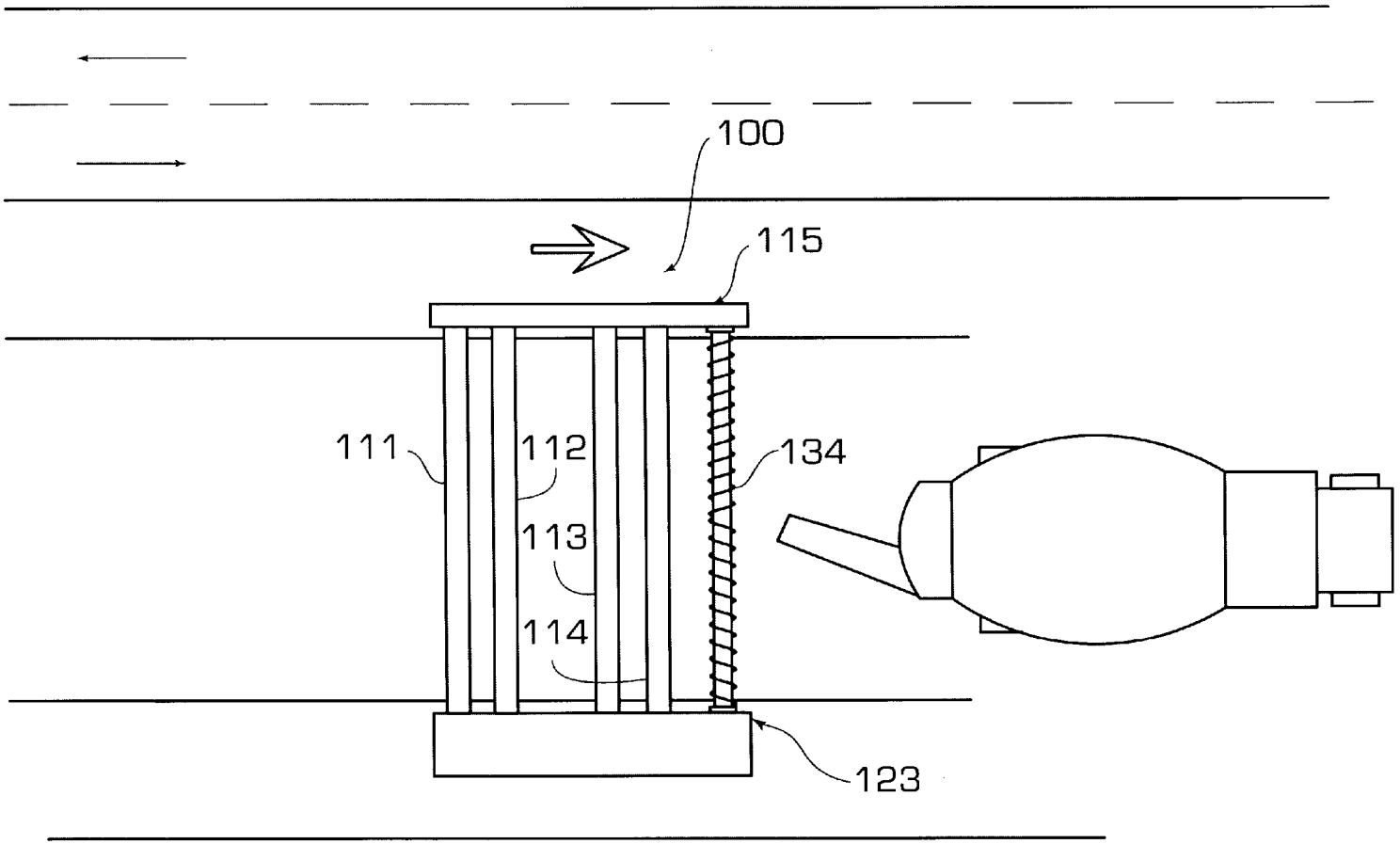
FIG. 9 shows a top view of a concrete truck and a four roller concrete finishing machine wherein an auger is added as a fifth roller according to the second embodiment of the present invention.
Figure 10:
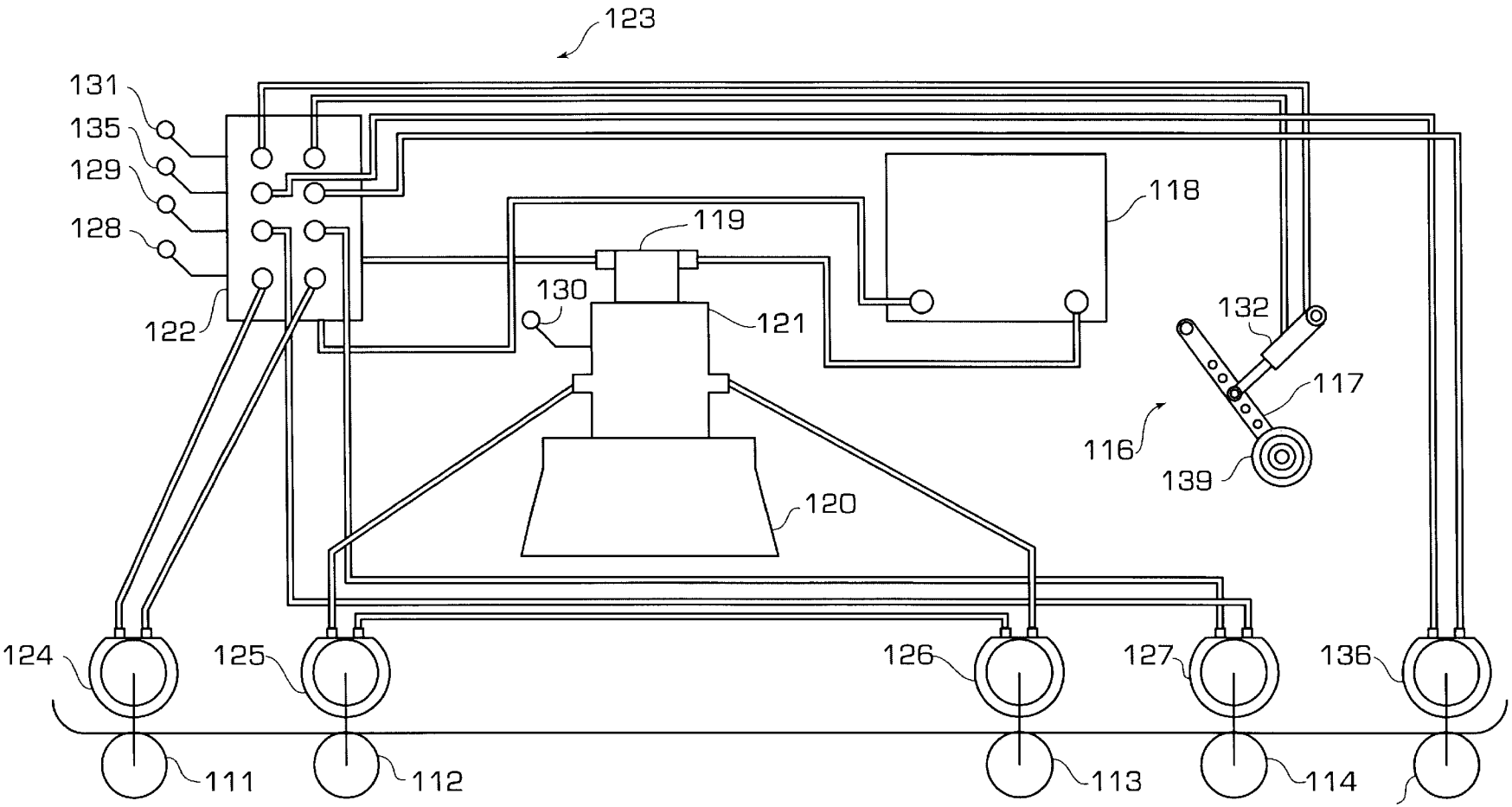
FIG. 10 shows a schematic of the hydraulic system of the concrete finishing machine which shows a concrete auger as a fifth roller of the concrete finishing machine, according to a second embodiment of the present invention, and a steering mechanism according to a third embodiment of the concrete finishing machine.
Figure 11:
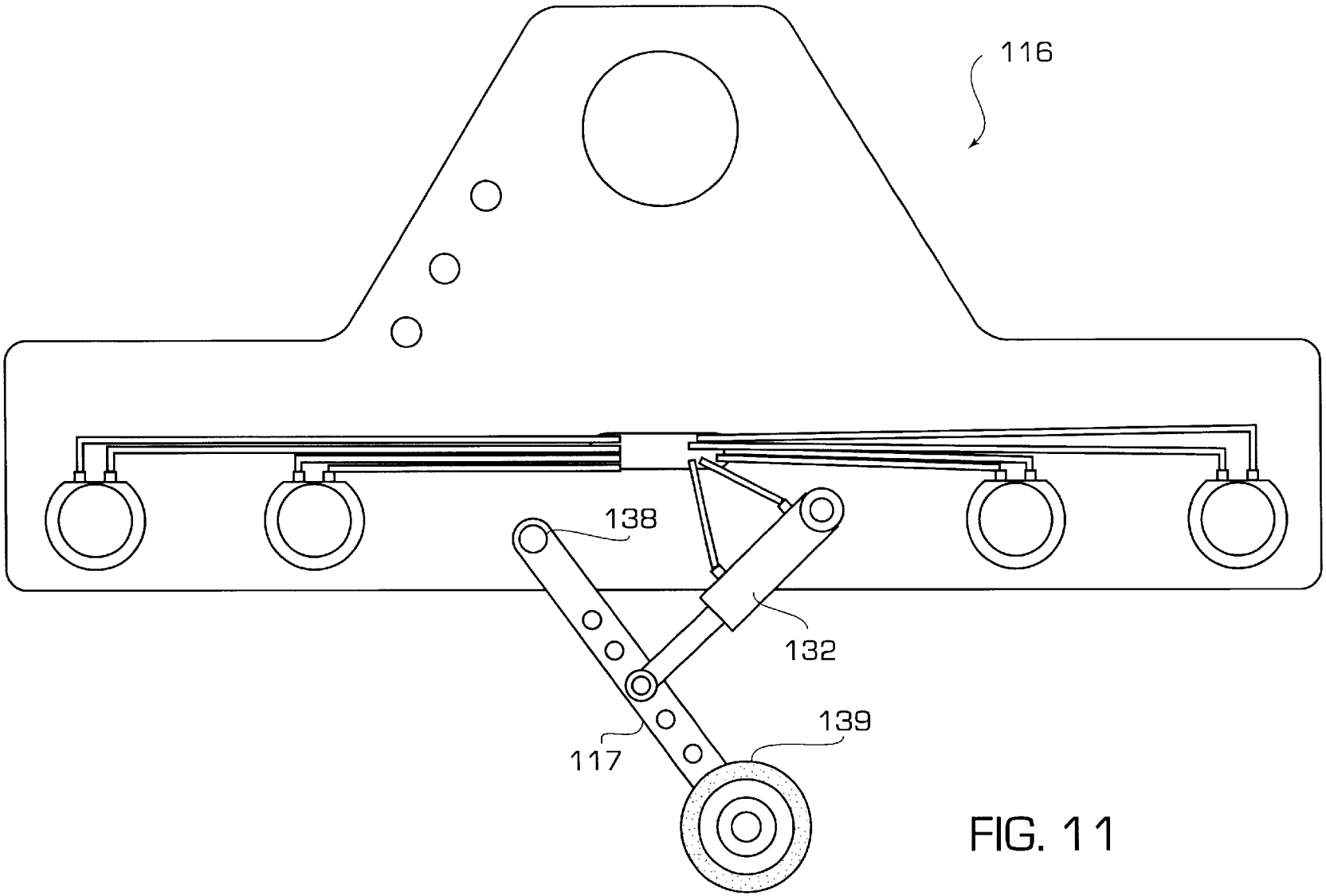
FIG. 11 shows a schematic of the steering mechanism of the four roller concrete finishing machine according to the third embodiment of the present invention.

In a second embodiment of the invention, a concrete auger 134 (see FIGS. 7–9), having spirals from the center trailing to the end, enters the unfinished concrete and is used to rough the concrete in the forward direction of travel of the concrete finishing machine 100 (see the arrow in FIG. 9). The concrete auger 134 may be added as a fifth roller 134 (see FIGS. 9 and 10) which can be selectively brought into use to rough the concrete and spread the concrete evenly, without taking the additional time required to stop the machine 100 and replace the leading finishing roller 114 with an auger. The auger 134 is driven independently of the leading finishing roller 114, the tramming rollers 112, 113, and the trailing finishing roller 111, by engaging lever 135 to drive torque motor 136 (see FIGS. 10–11).

Accordingly, when required, the auger 134 can be engaged to rough the concrete in the forward direction of travel and spread the concrete evenly, and then disengaged to allow finishing by the leading finishing roller 114 in the forward direction of travel. As with the first embodiment, finishing can still be performed in both the forward and the reverse directions of travel when the auger 134 is disengaged.

Further, when the auger 134 is engaged, the leading finishing roller 114 can either be engaged to rotate in the same direction as the auger 134, or be engaged to rotate in the direction of the tramming rollers 112, 113, and thus, act as a third tramming roller. Likewise, when the direction of the concrete finishing machine 100 is reversed, the roller 114 can be engaged either to act as a third tramming roller, or as a trailing finishing roller, whether or not the auger 134 is engaged.

With respect to a third embodiment of the present invention, although a four roller concrete finishing machine 100 can be steered by holding or forcing the machine 100, or by forcing the machine 100 against a bar or fixed object, like the conventional triple roller concrete finishing machine, the four roller concrete finishing machine 100 can be steered by rotating the finishing rollers 111, 114 together in the same direction or in opposite directions.

However, in the third embodiment of the present invention, a steering mechanism 116 operates such that lever 131 (see FIGS. 3 and 10) independently engages the valve 122 to drive the cylinder 132 to extend or retract the adjustable draw bar 117. The adjustable draw bar 117 has a pivot 138 at one end, and a wheel 139 at the other end, which affects the balance of the machine 100 to turn the four roller concrete finishing machine 100 in any direction (see FIG. 11). When extended, the adjustable draw bar 117 allows the wheel 139 to touch the ground (i.e., hardened concrete) outside the form, and the wheel 139 spins in an arc (i.e., is rotatable), so the concrete finishing machine 100 can be turned in an arc and the direction of the machine 100 changed. The wheel 139 extends on the operator side, or motor side (i.e., power unit 123 side) of the machine 100.

Figure 13:
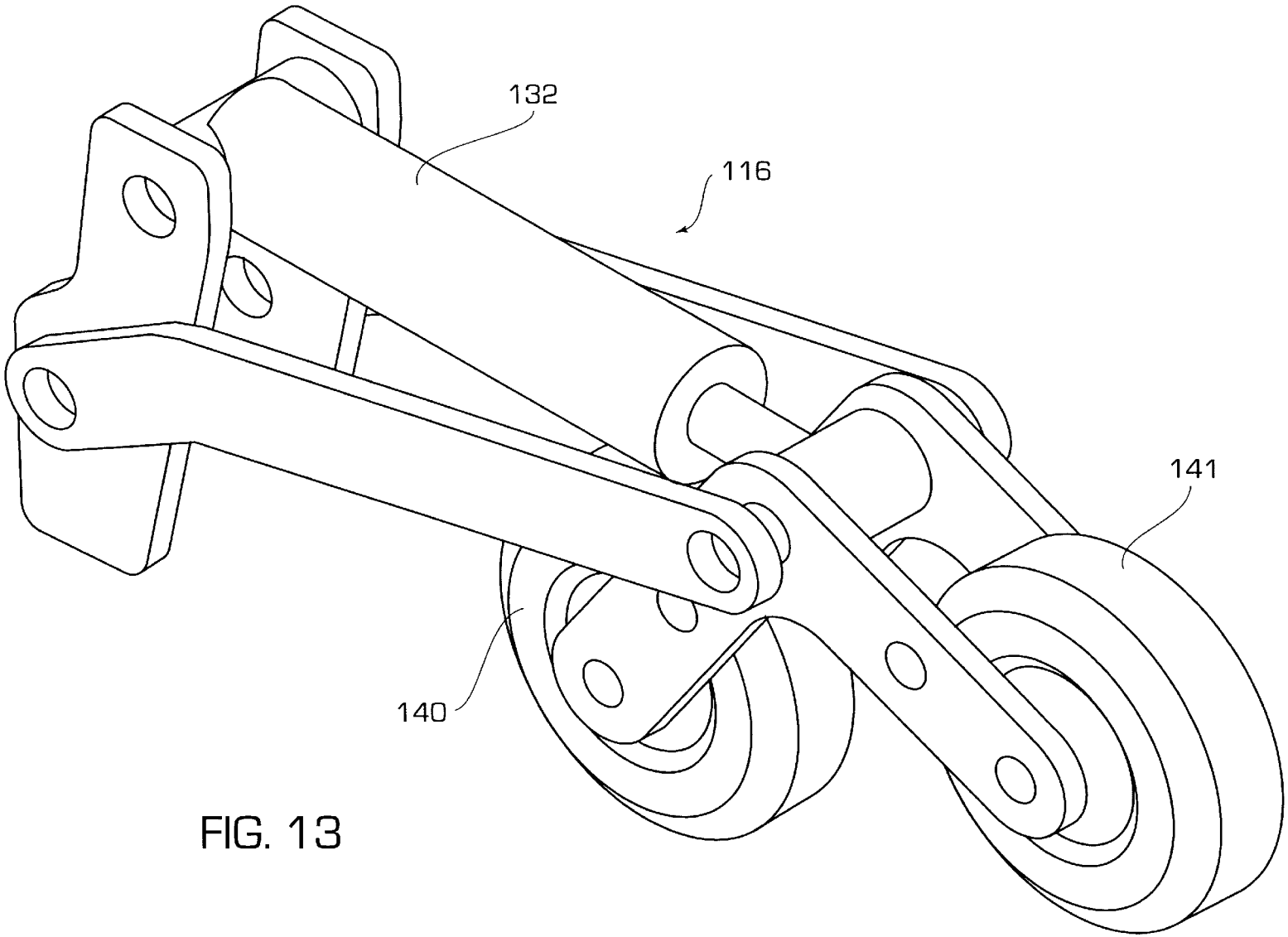
FIG. 13 shows an oblique view of an adjustable draw bar of the steering mechanism according to a variation of the third embodiment of the present invention, the adjustable draw bar being fully retracted.
Figure 14:
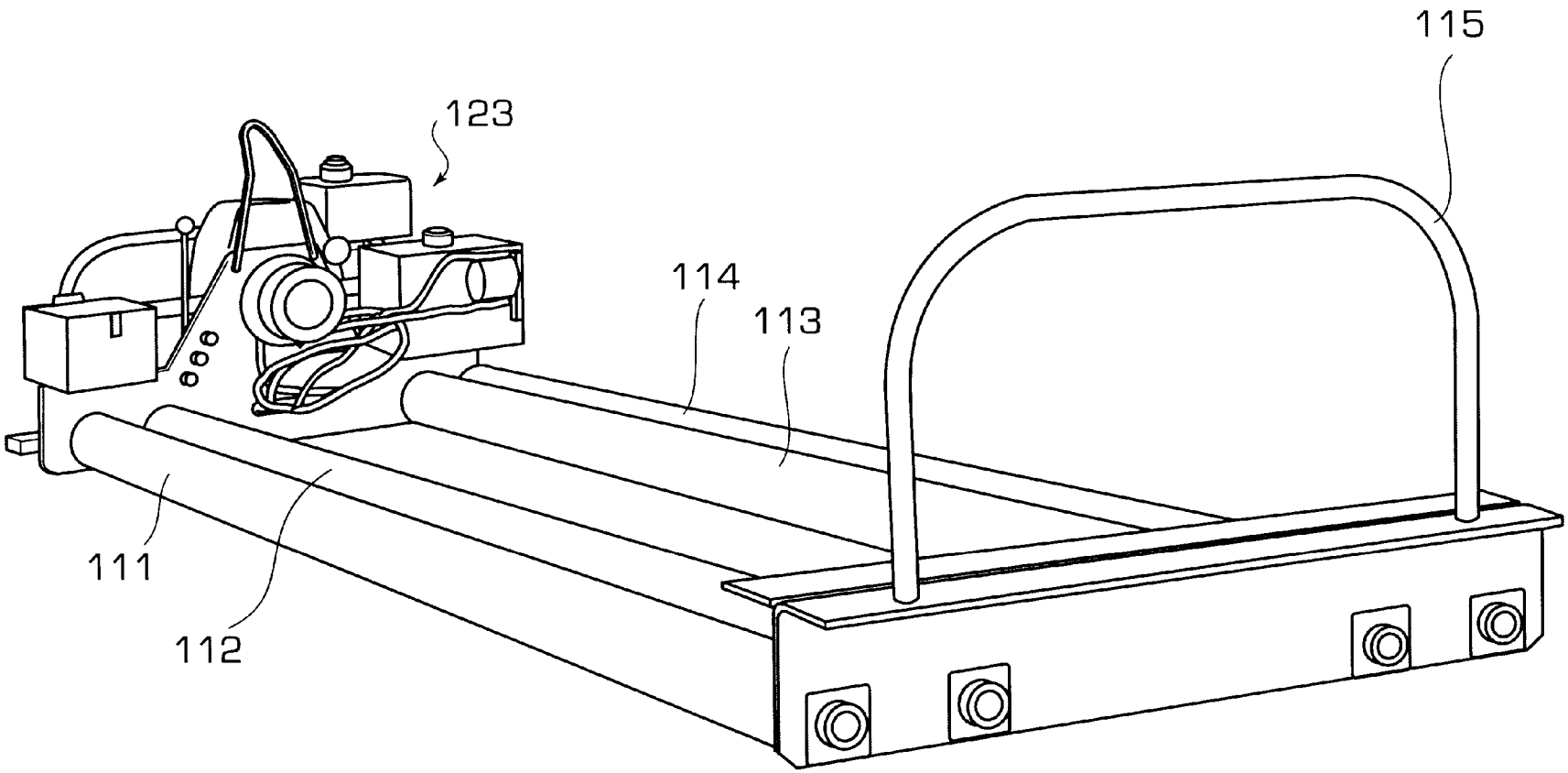
FIG. 14 shows a perspective view of the concrete finishing machine, according to a first embodiment of the present invention.

A variation of the single wheel 139 includes two smaller wheels 140, 141 (see FIGS. 13 and 14) which increase the stability of the machine 100 when it turns.

Figure 16:
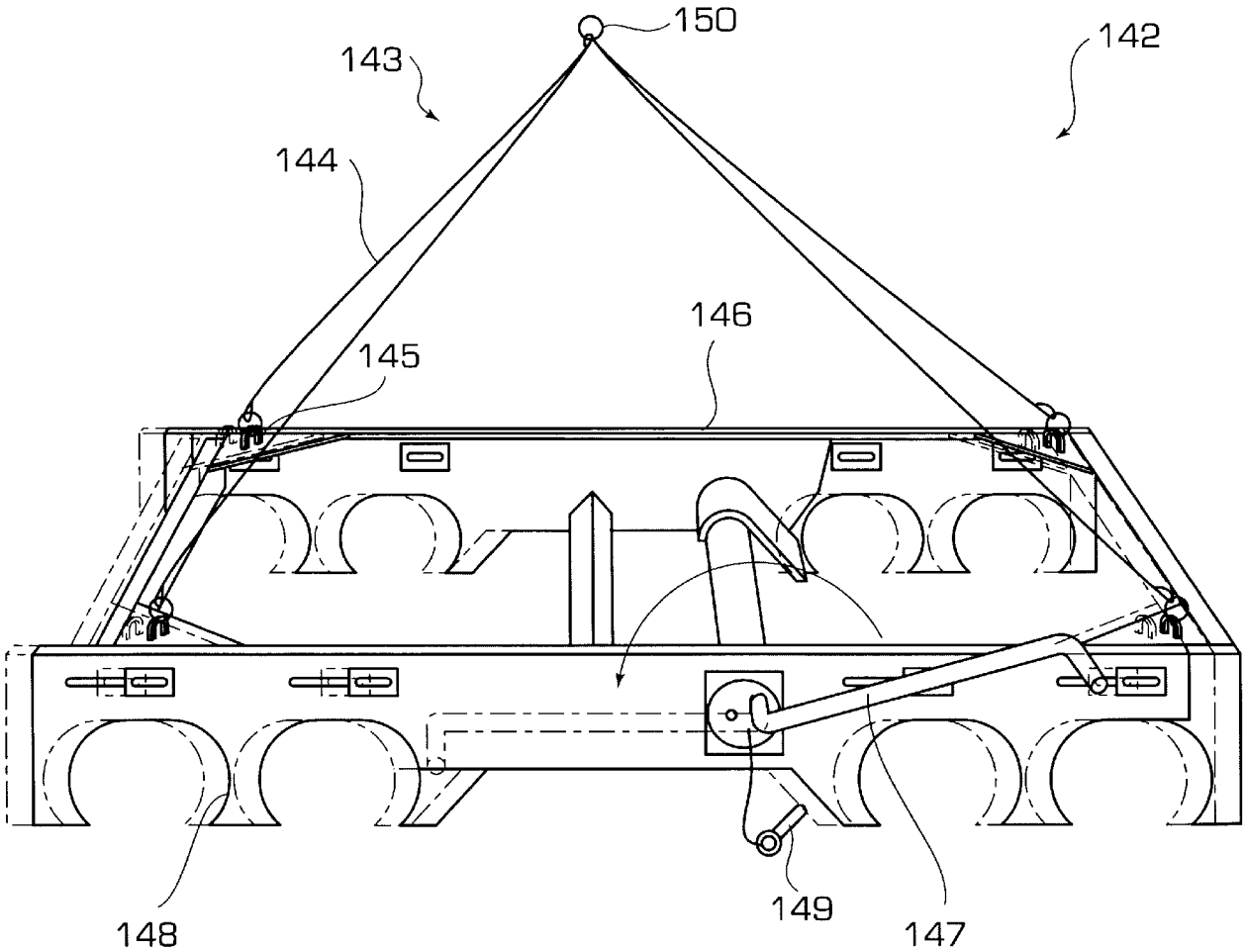
FIG. 16 shows a schematic of the lifting cradle, in the closed position, according to a first embodiment of the present invention.

A lifting cradle 142 (see FIGS. 15 and 16) provides the means to easily lift, move, and transport the concrete roller finishing machine 100 so that it is properly set in place at each jobsite. The lifting cradle 142 also allows the user to lift the machine 100 to change or add rollers during the concrete finishing operation.

The lifting cradle 142 (see FIGS. 15 and 16) includes a lifting sling 143, which consists of a wire rope sling 144 and a steel eyelet 145 attached to the lifting cradle frame 146, a cam lever 147 which opens and closes the pincers 148 of the lifting cradle 142, and a locking pin 149 which prevents the pincers 148 of the lifting cradle 142 from opening accidentally.

In the concrete finishing operation, the eyelet 150 of the lifting sling 143 is picked up by means of a powered mechanism (i.e., all terrain fork truck, backhoe/loader, etc.), and the lifting cradle 142 is trammed into position over the four roller concrete finishing machine 100. At this time, the locking pin 149 is removed, the cam lever 147 is turned clockwise to open the pincers 148 of the lifting cradle 142. The lifting cradle 142 is then lowered onto the four roller concrete finishing machine 100. The cam lever 147 is then turned counter clockwise, to close the pincers 148 of the lifting cradle 142, and the locking pin 149 is inserted. The lifting cradle 142 is then picked up by the powered mechanism, and transported with the four roller concrete finishing machine 100 in its grasp, to the required position on the concrete forms etc.

Once in position, the lifting cradle 142 is lowered to take tension from the lifting sling 143, the locking pin 149 is removed, and the cam lever 147 is turned clockwise to release its grip on the four roller concrete finishing machine 100. Then, the lifting cradle 142 is raised above the four roller concrete finishing machine 100 and placed away from the area of operation.

The four roller concrete finishing machine 100 is turned on and the levers 128, 129, 130 can be moved to control the tramming rollers 112, 113 and the leading and trailing rollers 114, 111, respectively. The levers 128, 129, 130 remain engaged until released by the operator. The movement of the levers 128, 129, 130 to their alternate positions reverses the direction of the rollers' 111–114 rotation.

Once the four roller concrete finishing machine 100 has been placed, either on forms, or existing concrete, or on one form and existing concrete, the concrete truck, or hopper is put into position (see FIG. 4).

With the concrete truck in position, the concrete is discharged from the truck into a U-shaped pattern at a distance of 6 to 8 feet. A U-shaped pattern is not needed but does help when the machine 100 advances, for as the machine 100 advances, it spreads the extra unfinished concrete towards the outer edge. By placing the unfinished concrete in a U-shape, the concrete is kept mostly in the center, and reduces the need of extra shoveling.

At this time, workers shovel concrete to the comers. This is in preparation for the advance of the machine 100. Then the leading finishing roller (i.e., roller 114) is engaged counter clockwise by lever 129, and the tramming rollers 112, 113 are engaged by lever 130, to bring the leading finishing roller 114 into the concrete. The trailing finishing roller 111 can either be engaged to turn in the same direction as the leading finishing roller 114, or disengaged.

As the machine 100 advances, the unfinished concrete above the grade will form a curl and be pushed ahead and towards the outer edge of the leading finishing roller 114. As the machine 100 approaches the edge of the rough concrete, the chute operator in the concrete truck repeats his placement of the concrete as before.

The steps above are repeated to level the concrete to grade until the concrete has been emptied from the concrete truck or hopper. At this time, the concrete truck will depart, and the tramming rollers 112, 113 will be engaged by lever 130 to bring the machine 100 back to its starting position. The machine will make several passes over the placed concrete until the leading finishing roller 114 is pushing a minimum amount of rough concrete.

At this time, the machine 100 will again be driven back by tramming rollers 112, 113 back to its start position. Then the leading finishing roller 114 will be disengaged and the trailing finishing roller 111 will be engaged in a counter clockwise direction to act as the leading finishing roller. The roller 114, which is now the trailing finishing roller, may also be engaged in a counter clockwise direction in synchronicity with the roller 111. The tramming rollers 112, 113 will advance the machine 100 as the roller 111 pushes the rough concrete ahead of it. This will give the concrete a finished appearance. If necessary, a small amount of water can be sprayed ahead of the machine 100. This will bring the rough concrete more quickly to the top of the screeding plane.

The concrete finishing machine 100 can also have an auger 134 added as a fifth roller, as stated above. The auger 134 is operated by lever 135 via torque motor 136, and is selectively brought into use in order to rough the concrete and spread the concrete from the center line. When the auger 134 is in use, the leading finishing roller 114 is either independently driven either in the same direction as the auger 134, or driven to turn in the same direction as the tramming rollers 112, 113, or is disengaged and remains essentially stationary. However, when the auger 134 is no longer required, bi-directionality of the machine 100 is retained without having to stop and to replace the auger 134 with the leading finishing roller as in the second embodiment, as the auger 134 can be removed and the leading finishing roller 114 can perform smoothing of the concrete surface.

As stated above, the adjustable draw bar 117 of the steering mechanism 116 allows the machine 100 to be turned in any direction, which further adds to its versatility. Adjustable draw bar 117 is operated by lever 131, and can be selectively brought into use via the operation of the cylinder 132 to operate on the concrete surface outside the concrete form, and allow easier steering in any direction.

It is contemplated that numerous modifications may be made to the apparatus and procedure of the invention without departing from the spirit and scope of the invention as defined in the following claims.

What is claimed is:

1. A concrete finishing machine for finishing concrete on a surface to be paved, comprising:

a leading finishing roller which rotates in one of a first direction and a second direction opposite to said first direction;

a trailing finishing roller which rotates in one of said first direction and said second direction;

a first tramming roller which rotates in one of said first direction and second direction, and disposed between said leading finishing roller and said trailing finishing roller;

a second tramming roller which rotates in one of said first direction and said second direction and which is disposed adjacent said first tramming roller and disposed between said leading finishing roller and said trailing finishing roller; and a drive mechanism which drives said leading finishing roller, said trailing finishing roller, said first tramming roller and said second tramming roller;

wherein said leading finishing roller and said trailing finishing roller rotate in a common direction which is opposite to said rotation direction of said first tramming roller and said second tramming roller.

2. The concrete finishing machine according to claim 1, further comprising:

a concrete auger disposed adjacent said leading roller and driven by said drive mechanism to rough said concrete on said surface.

3. The concrete finishing machine according to claim 2, wherein said drive mechanism comprises:

a hydraulic transmission which drives said first tramming roller and said second tramming roller using a first torque motor and a second torque motor, respectively;

a valve which drives said leading finishing roller and said trailing finishing roller using a third torque motor and a fourth torque motor, respectively, and which drives said auger via a fifth torque motor.

4. The concrete finishing machine according to claim 1, wherein said leading finishing roller and said trailing finishing roller are driven by said drive mechanism independently from each other and from said first tramming roller and said second tramming roller.

5. The concrete finishing machine according to claim 1, further comprising:

a steering mechanism which steers the machine in any direction.

6. The concrete finishing machine according to claim 5, wherein said steering mechanism comprises:

an adjustable draw bar having a pivot at one end and a first wheel at the other end, said first wheel which touches said concrete on said surface and is rotatable; and a cylinder connected to said adjustable draw bar at a central portion thereof, wherein said cylinder pulls said adjustable draw bar in a direction toward said cylinder, such that said first wheel is lifted from said surface of said concrete.

7. The concrete finishing machine according to claim 6, wherein said steering mechanism further comprises:

a second wheel to increase stability of said steering mechanism.

8. The concrete finishing machine according to claim 5, wherein said leading finishing roller and said trailing finishing roller are driven by said drive mechanism independently from each other and from said first tramming roller and said second tramming roller, and said steering mechanism is driven independently from said leading finishing roller, said trailing finishing roller, and said first tramming roller and said second tramming roller.

9. The concrete finishing machine according to claim 8, wherein said drive mechanism comprises:

a hydraulic transmission which drives said first tramming roller and said second tramming roller using a first torque motor and a second torque motor, respectively;

a valve which drives said leading roller and said trailing roller using a third torque motor and a fourth torque motor, respectively, and which drives said steering.

10. A concrete finishing machine for finishing concrete on a surface to be paved, comprising:

a leading finishing roller which rotates in one of a first direction and a second direction opposite to said first direction;

a trailing finishing roller which rotates in one of said first direction and said second direction;

a first tramming roller which rotates in one of said first direction and said second direction, and disposed between said leading finishing roller and said trailing finishing roller;

a second tramming roller which rotates in one of said first direction and said second direction and which is disposed adjacent said first tramming roller and disposed between said leading finishing roller and said trailing finishing roller; and a drive mechanism which drives said leading finishing roller, said trailing finishing roller, said first tramming roller and said second tramming roller;

wherein said leading finishing roller and said trailing finishing roller rotate in a common direction which is opposite to said rotation direction of said first tramming roller and said second tramming roller; and means for steering said machine in any direction.

11. The concrete finishing machine according to claim 10, further comprising:

a concrete auger disposed adjacent said leading roller and driven by said drive mechanism to rough said concrete on said surface.

12. The concrete finishing machine according to claim 11, wherein said drive mechanism comprises:

a hydraulic transmission which drives said first tramming roller and said second tramming roller using a first torque motor and a second torque motor, respectively;

a valve which drives said leading finishing roller and said trailing finishing roller using a third torque motor and a fourth torque motor, respectively, and which drives said auger using a fifth torque motor, and which drives said steering means.

13. The concrete finishing machine according to claim 10, wherein said leading finishing roller and said trailing finishing roller are driven by said drive mechanism independently from each other and from said first tramming roller and said second tramming roller.

14. The concrete finishing machine according to claim 10, wherein said steering means comprises:

an adjustable draw bar having a pivot at one end and a first wheel at the other end, said first wheel which touches said concrete on said surface and is rotatable; and a cylinder connected to said adjustable draw bar at a central portion thereof, wherein said cylinder pulls said adjustable draw bar in a direction toward said cylinder, such that said first wheel is lifted from said surface of said concrete.

15. The concrete finishing machine according to claim 14, wherein said steering means further comprises:

a second wheel to increase stability of said steering means.

16. A concrete finishing machine for finishing concrete on a surface to be paved, comprising:

a leading finishing roller which rotates in one of a first direction and a second direction opposite to said first direction;

a trailing finishing roller which rotates in one of said first direction and said second direction;

a first tramming roller which rotates in one of said first direction and said second direction, and disposed between said leading finishing roller and said trailing finishing roller;

a second tramming roller which rotates in one of said first direction and said second direction and which is disposed adjacent said first tramming roller and disposed between said leading finishing roller and said trailing finishing roller; and a drive mechanism which drives said leading finishing roller, said trailing finishing roller, said first tramming roller and said second tramming roller;

wherein said leading finishing roller and said trailing finishing roller rotate in a common direction which is opposite to said rotation direction of said first tramming roller and said second tramming roller;

a steering mechanism which steers said machine in any direction; and a concrete auger disposed adjacent said leading roller and driven by said drive mechanism, to rough said concrete on said surface.

17. A method of finishing concrete on a surface to be paved using a concrete finishing machine, comprising the steps of:

placing said concrete finishing machine into an initial position on at least one of forms and unfinished concrete;

discharging unfinished concrete in front of a leading finishing roller of said machine;

driving said leading finishing roller so that said leading finishing roller rotates independently in a first direction;

driving a trailing finishing roller of said machine so that said trailing finishing roller rotates in said first direction;

driving a plurality of tramming rollers so that said tramming rollers rotate independently of at least said leading finishing roller in a second direction opposite to said first direction, and advancing said machine over said unfinished concrete in said second direction using said driven tramming rollers;

leveling said concrete to grade using said leading finishing roller and said trailing finishing roller;

driving said tramming rollers in said first direction to return said machine to said initial position and repeating the discharging, driving, and leveling steps in said second direction;

returning said machine to said initial position once a minimum amount of rough concrete is finished;

disengaging the driving of said leading finishing roller and trailing finishing roller;

driving said trailing finishing roller and said leading finishing roller in said second direction;

driving said plurality of tramming rollers so that said tramming rollers rotate independently of at least said trailing finishing roller in said first direction, and advancing said machine over said unfinished concrete in said first direction using said driven tramming rollers;

leveling said concrete to grade using said trailing finishing roller and said leading finishing roller;

driving said tramming rollers in said second direction to return said machine to said initial position and repeating the discharging, driving, and leveling steps in said first direction, until said surface is finished smoothly.

18. The method of finishing concrete according to claim 17, further comprising the step of steering said machine in any direction using a steering mechanism, said steering step being performed during said leveling steps.

19. The method of finishing concrete according to claim 17, further comprising the step of roughing said concrete using an auger, prior to driving said leading roller, so that said concrete is spread evenly.

20. A method of finishing concrete on a surface to be paved using a concrete finishing machine, comprising the steps of:

placing said concrete finishing machine into an initial position on at least one of forms and unfinished concrete;

discharging unfinished concrete in front of an auger of said machine;

driving said auger so that said auger rotates in a first direction;

driving a plurality of tramming rollers so that said tramming rollers rotate independently of said auger in a second direction opposite to said first direction, and advancing said machine over said unfinished concrete in said second direction using said driven tramming rollers;

roughing said concrete using said auger;

driving said tramming rollers in said first direction to return said machine to said initial position;

disengaging the driving of said auger;

driving a leading finishing roller so that said leading finishing roller rotates independently in said first direction;

driving a trailing finishing roller of said machine so that said trailing finishing roller rotates in said first direction;

driving said plurality of tramming rollers so that said tramming rollers rotate independently of at least said leading finishing roller in a second direction opposite to said first direction, and advancing said machine over said unfinished concrete in said second direction using said driven tramming rollers;

leveling said concrete to grade using said leading finishing roller and said trailing finishing roller;

driving said tramming rollers in said first direction to return said machine to said initial position and repeating the discharging, roughing, driving, and leveling steps in said second direction;

driving said trailing finishing roller and said leading finishing roller in said second direction;

driving said plurality of tramming rollers so that said tramming rollers rotate independently of at least said trailing finishing roller in said first direction, and advancing said machine over said unfinished concrete in said first direction using said driven tramming rollers;

leveling said concrete to grade using said trailing finishing roller and said leading finishing roller;

driving said tramming rollers in said second direction to return said machine to said initial position and repeating the discharging, roughing, driving, and leveling steps in said first direction, until said surface is finished smoothly.

21. The method of finishing concrete according to claim 20, further comprising the step of steering said machine in any direction using a steering mechanism, said steering step being performed during said leveling step.

22. The method of finishing concrete according to claim 20, wherein when said auger is applied, said leading finishing roller is driven in said second direction in concurrence with said plurality of tramming rollers.

23. A method of finishing concrete on a surface to be paved using a concrete finishing machine, comprising the steps of:

placing said concrete finishing machine into an initial position on at least one of forms and unfinished concrete;

discharging unfinished concrete in front of a leading finishing roller of said machine;

driving said leading finishing roller so that said leading finishing roller rotates independently in a first direction;

driving a trailing finishing roller of said machine so that said trailing finishing roller rotates in said first direction;

driving a plurality of tramming rollers so that said tramming rollers rotate independently of at least said leading finishing roller in a second direction opposite to said first direction, and advancing said machine over said unfinished concrete in said second direction using said driven tramming rollers;

steering said machine in any direction using a steering mechanism;

leveling said concrete to grade using said leading finishing roller and said trailing finishing roller;

driving said tramming rollers in said first direction to return said machine to said initial position and repeating the discharging, driving, and leveling steps in said second direction;

returning said machine to said initial position once a minimum amount of rough concrete is finished;

disengaging the driving of said leading finishing roller and said trailing finishing roller;

driving said trailing finishing roller and said leading finishing roller in said second direction;

driving said plurality of tramming rollers so that said tramming rollers rotate independently of at least said trailing finishing roller in said first direction, and advancing said machine over said unfinished concrete in said first direction using said driven tramming rollers;

steering said machine in any direction using said steering mechanism;

leveling said concrete to grade using said trailing finishing roller and said leading finishing roller;

driving said tramming rollers in said second direction to return said machine to said initial position and repeating the discharging, driving, and leveling steps in said first direction, until said surface is finished smoothly.

24. A concrete finishing system for finishing concrete on a surface to be paved, comprising:

a lifting cradle;

a concrete finishing machine, said concrete finishing machine comprising:

a driving mechanism which drives said concrete finishing machine; and a finishing mechanism which includes a leading finishing roller, a trailing finishing roller, a first tramming roller, and a second tramming roller and which finishes said concrete on said surface in a bi-directional manner, such that said concrete is smoothed on said surface;

wherein said lifting cradle lifts and places said concrete finishing machine onto said concrete on said surface to be paved, and further wherein said lifting cradle comprises four apertures which accommodate and hold said leading finishing roller, said trailing finishing roller, said first tramming roller, and said second tramming roller, when said machine is lifted.

25. A concrete finishing system for finishing concrete on a surface to be paved, comprising:

a lifting cradle;

a concrete finishing machine, said machine comprising:

a leading finishing roller which rotates in one of a first direction and a second direction opposite to said first direction;

a trailing finishing roller which rotates in one of said first direction and said second direction;

a first tramming roller which rotates in one of said first direction and said second direction, and disposed between said leading finishing roller and said trailing finishing roller;

a second tramming roller which rotates in one of said first direction and said second direction and which is disposed adjacent said first tramming roller and disposed between said leading finishing roller and said trailing finishing roller; and a drive mechanism which drives said leading finishing roller, said trailing finishing roller, said first tramming roller and said second tramming roller;

wherein said leading finishing roller and said trailing finishing roller rotate opposite to said rotation direction of said first tramming roller and said second tramming roller; and wherein said lifting cradle lifts and places said concrete finishing machine onto said concrete on said surface to be paved, and further wherein said lifting cradle comprises four apertures which accommodate and hold said leading finishing roller, said trailing finishing roller, said first tramming roller, and said second tramming roller, when said machine is lifted.

26. A method of finishing concrete on a surface to be paved using a concrete finishing machine, comprising the steps of:

placing said concrete finishing machine into an initial position on at least one of forms and unfinished concrete using a lifting cradle, said lifting cradle comprising four apertures which accommodate and hold a leading finishing roller, a trailing finishing roller, a first tramming roller, and a second tramming roller of said concrete finishing machine;

discharging unfinished concrete in front of said leading finishing roller of said machine;

driving said leading finishing roller in a first direction;

driving said first and said second tramming rollers in a second direction opposite to said first direction, and advancing said machine over said unfinished concrete in said second direction using said driven tramming rollers;

leveling said concrete to grade using said leading finishing roller;

returning said machine to said initial position once a minimum amount of rough concrete is finished;

disengaging the driving of said leading finishing roller;

driving said trailing finishing roller;

driving said first and said second tramming rollers in said first direction, and advancing said machine over said unfinished concrete in said first direction using said driven tramming rollers;

leveling said concrete to grade using said trailing finishing roller; and returning said machine to said initial position once a minimum amount of rough concrete is finished.

27. A method of finishing concrete on a surface to be paved using a concrete finishing machine, comprising the steps of:

placing said concrete finishing machine into an initial position on at least one of forms and unfinished concrete;

discharging unfinished concrete in front of a leading finishing roller of said machine;

driving said leading finishing roller and a trailing finishing roller of said machine in a first direction;

driving a plurality of tramming rollers in a second direction opposite to said first direction, and advancing said machine over said unfinished concrete in said second direction using said driven tramming rollers;

leveling said concrete to grade using said leading finishing roller and said trailing finishing roller;

returning said machine to said initial position once a minimum amount of rough concrete is finished;

disengaging the driving of said leading finishing roller and the trailing finishing roller;

driving said trailing finishing roller and said leading finishing roller in said second direction;

driving said plurality of tramming rollers in said first direction, and advancing said machine over said unfinished concrete in said first direction using said driven tramming rollers;

leveling said concrete to grade using said trailing finishing roller and said leading finishing roller; and returning said machine to said initial position once a minimum amount of rough concrete is finished.

28. The method of finishing concrete according to claim 27, further comprising the step of steering said machine in any direction using a steering mechanism, said steering step being performed during said leveling step.

29. The method of finishing concrete according to claim 27, further comprising the step of roughing said concrete using an auger, prior to driving said leading finishing roller, so that said concrete is spread evenly.

30. A concrete finishing machine for finishing concrete on a surface to be paved, comprising:

a leading finishing roller which rotates in one of a first direction and a second direction opposite to said first direction;

a trailing finishing roller which rotates in one of said first direction and said second direction;

a first tramming roller which rotates in one of said first direction and second direction, and disposed between said leading finishing roller and said trailing finishing roller;

a second tramming roller which rotates in one of said first direction and said second direction and which is disposed adjacent said first tramming roller and disposed between said leading finishing roller and said trailing finishing roller; and a drive mechanism which drives said leading finishing roller, said trailing finishing roller, said first tramming roller and said second tramming roller;

wherein said leading finishing roller and said trailing finishing roller rotate opposite to said rotation direction of said first tramming roller and said second tramming roller, said concrete finishing machine further comprising:

a steering mechanism which steers the machine in any direction, wherein said steering mechanism comprises:

an adjustable draw bar having a pivot at one end and a first wheel at the other end, said first wheel which touches said concrete on said surface and is rotatable; and a cylinder connected to said adjustable draw bar at a central portion thereof, wherein said cylinder pulls said adjustable draw bar in a direction toward said cylinder, such that said first wheel is lifted from said surface of said concrete.

* * * * *